United States Patent [19]

Ushiyama et al.

[11] Patent Number: 4,497,885

[45] Date of Patent: Feb. 5, 1985

[54] PRESSURE-FIXABLE MICROCAPSULE TONER

[75] Inventors: Hisayuki Ushiyama, Hiratsuka; Ichiro Ohsaki, Kawasaki; Masanori Takenouchi, Urawa; Toshiaki Nakahara, Kawasaki, all of Japan

[73] Assignee: Canon Kabushiki Kaisha, Tokyo, Japan

[21] Appl. No.: 588,805

[22] Filed: Mar. 12, 1984

[30] Foreign Application Priority Data

Mar. 17, 1983 [JP] Japan ..... 58-44651

[51] Int. Cl.[3] ..... G03G 9/14

[52] U.S. Cl. ..... 430/106.6; 430/109; 430/111; 430/137; 430/138; 430/98

[58] Field of Search ..... 430/138, 98, 111, 137, 430/106.6, 109; 428/402.2

[56] References Cited

U.S. PATENT DOCUMENTS 4,254,201 3/1981 Sawai et al. ..... 430/111

4,357,406 11/1982 Kouchi et al. ..... 430/137

*Primary Examiner*—John D. Welsh

*Attorney, Agent, or Firm*—Fitzpatrick, Cella, Harper & Scinto

[57] ABSTRACT

A microcapsule toner for pressure fixing, comprising a core material containing a pressure-fixable component and a magnetic material, a first shell layer comprising a formaldehyde copolymer resin and a second shell layer comprising a polymer soluble in an organic solvent provided successively by coating therearound. This microcapsule, since a pressure-fixable core material is successively coated with a lipophobic first shell layer and a lipophilic second shell layer, has well-balanced pressure fixing characteristic and developing characteristic without core material exposed on the surface.

11 Claims, No Drawings

PRESSURE-FIXABLE MICROCAPSULE TONER

BACKGROUND OF THE INVENTION

1. Field of the Invention

This invention relates to a toner for electrophotography, particularly to a capsule toner suitable for pressure fixing.

2. Description of the Prior Art

Electrophotographic developing methods such as the powder cloud method, the fur brush method, the cascade developing method and the magnetic brush developing method have been known in the art. For the toner to be used in these methods, fine colored powder of a natural or synthetic resin containing a dye or pigment dispersed therein has been used. For example, in the magnetic brush method which is widely practiced in these days, a two-component developer comprising a mixture of iron powder called as the carrier and a toner is employed. In the case of such a two-component developer, for maintaining good development, cumbersome operations are required for maintenance and adjustment to cope with carrier contamination and toner concentration changes. In recent years, the magnetic brush method employing a one-component developer containing fine magnetic particles such as of magnetite incorporated therein has been developed and is now coming to be practically utilized.

As the system for fixing the toner image developed, it is generally practiced to heat and melt the toner by an infrared radiation heater or a heating roller, thereby effecting fusion and solidification onto a supporting medium. However, for the reasons such as prevention of dangers such as fire and saving of power consumed, a pressure fixing system using a rigid body roller is gradually being adopted.

Toners are made of materials which are chosen so as to be adapted for the respective fixing methods, and, generally speaking, a toner applicable for a specific method cannot be used for another mixing method. Particularly, it is impossible to utilize a toner for heat fusion fixing with an infrared radiation heater as a toner for hot roller fixing. Much less, there is no exchangeability at all between the toner for heat fixing and the toner for pressure fixing. Accordingly, toners have been developed which are suitable for individual fixing methods, and the toner for the one-component pressure fixing method is still now investigated for further improvement.

The method to fix toner by pressurization has a number of advantages, such that there is no danger of scorching of the copied sheet, that copying can be done without waiting time after turning on the power source, that high speed fixing is possible and that the fixing device is simple.

For such a pressure-fixable toner, the constituent resin is required to have characteristics suitable for pressure fixing, and the resins suited for this purpose are actively being developed. However, no practical pressure-fixable toner has yet been obtained, which is excellent in pressure fixability, without causing off-set to the pressure rollers, stable in developing and fixing performances during repeated uses, without causing adhesion onto carriers, metal sleeve or the surface of a photosensitive member, and also stable in storage stability without agglomeration or caking during storage. Particularly, with respect to pressure fixability, a problem remains in fixability onto a plain paper.

For example, a pressure-fixable toner comprising a soft material is relatively good in pressure fixability, but it is difficult to make the soft material into toners by micropulverization, and the toner obtained thereby also involves various problems such as tendency to cause off-set to the pressure rollers or other troubles such as adhesion, agglomeration or caking.

On the other hand, a rigid resin is very poor in pressure fixability, although it can be made into toners easily and can readily provide a toner excellent in charging, storage and other characteristics.

For these reasons, various proposals have also been made of toners of the capsule type having a soft material or a liquid as the core material which is enclosed within a shell of a rigid resin.

For example, as disclosed in Japanese Laid-open Patent Application No. 139745/1975, encapsulation is effected by spray-drying a dispersion of the powder of a kneaded product of an aliphatic compound and magnetic powder in a solution of a polymer for forming a coated film dissolved in an organic solvent. However, since an aliphatic compound has a slight solubility in an organic solvent, the resultant capsule involves the drawbacks such that presence of the aliphatic compound of the core material on the surface of the capsule will markedly lower the free flowing property of the toner and also that blocking of the toner occurs during storage.

The microcapsule toner disclosed in U.S. Pat. No. 4,254,201 is prepared by spray-drying with a spray drier a mixture of a pressure-fixable core material coated with a film-forming polymer, additives such as magnetic material, carbon black, etc. and a latex emulsion. However, because the toner thus obtained contains a water-soluble resin or a surfactant contained as a stabilizer of the latex emulsion as such on the toner surface, electric resistance of the toner may be lowered under humid conditions, whereby developing and transfer characteristics may be worsened.

SUMMARY OF THE INVENTION

An object of the present invention is to provide a toner improved in the disadvantages as described above.

A specific object of the present invention is to provide a capsule toner which is free from the pressure-fixable component of the core material on the surface of the capsule.

Still another object of the present invention is to provide a toner which is free from a surfactant on the toner surface.

The above objects of the present invention can be accomplished by coating a core material containing an olefin and a magnetic material with a first shell layer of a formaldehyde copolymer resin obtained through addition and/or condensation reaction of formaldehyde and by further coating the first shell layer with a second polymeric shell layer precipitated by phase separation from an organic solution.

In the microcapsule toner of the present invention, the product obtained by coating the core material of a pressure-fixable component with a first lipophobic shell layer in water is further coated with a second shell layer by phase separation from an organic solution, and therefore the core material will not be dissolved in the vehicle during encapsulation, whereby the core material of a pressure-fixable component will not exist on the capsule surface. Further, since no surfactant is used in encapsulation, no surfactant exists in the capsule.

The present invention will be described in further detail below. In the following description, unless specifically otherwise noted, "parts" and "%" are by weight.

DESCRIPTION OF THE PREFERRED EMBODIMENTS

The core material of the microcapsule toner of the invention comprises a pressure-fixable component, a magnetic material and other optional additives.

Core materials generally contain pressure-fixable components, and the pressure-fixable component to be contained in the core material of the present invention may preferably be a soft material having a penetration at 25° C. (according to JIS K 2530) of 1 or above, more preferably of 1–10, which can be readily entangled with the fibers of a plain paper under a line pressure of about 15 kg/cm or below. Typical examples may include polyethylene, ethylene-vinyl acetate copolymer, polyvinylidene fluoride, polybutadiene, polybutene, paraffin, palmitic acid, stearic acid, lauric acid, carnauba wax, caudelilla wax, rice wax, bees wax, micro wax, montan wax, ceresine wax, ozokerite, shellac wax, sazol wax, and mixtures or reaction products of the above. The pressure fixable component can also comprise a mixture or reaction product of a soft material as mentioned above and a resin which per se is thermoplastic.

The magnetic material may be a material which is magnetic or magnetizable. For example, it is possible to use fine powder of a metal such as iron, manganese, nickel, cobalt or chromium, various ferrites, alloys or compounds such as of manganese and other strongly magnetic alloys, which have conventionally known as magnetic materials. These magnetic materials may be used in an amount of 40 to 100 parts per 100 parts of the above pressure-fixable material.

The first shell layer of the present invention comprises a formaldehyde copolymer resin. The formaldehyde copolymer resin as herein mentioned refers to a resin obtained by addition and/or condensation reaction of formaldehyde with a comonomer. The comonomer may be phenol, urea, acetoguanamine, benzoguanamine, 2-diethylaminomelamine, o-xylene, m-xylene, p-xylene, mesitylene, 1,2,4-trimethylbenzene, naphthalene, acenaphthene, acenaphthylene, p-cresol and the like, which may be used singly or in combination.

Thus, formaldehyde can form a lipophobic resin such as a phenol resin or an aminoplast, by repeating the addition reaction or the condensation reaction as shown below with a comonomer as mentioned above comprising an aromatic compound such as phenols or a compound having an amino group:

$$R{-}H + CH_2O \rightarrow R{-}CH_2OH \text{ (Addition)}$$

$$R{-}CH_2OH + R{-}H \rightarrow R{-}CH_2{-}R + H_2O \text{ (Condensation).}$$

In the present invention, the polymeric substance for the second shell layer may include, for example, homopolymers of styrene or its substituted derivative such as polystyrene, poly-p-chlorostyrene, polyvinyltoluene and the like; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and the like; polymethyl methacrylate, polybutyl methacrylate, polyvinyl chloride, polyvinyl acetate, polyethylene, polypropylene, polyester, polyurethane, polyamide, epoxy resin, polyvinyl butyral, polyamide, polyacrylic resin, rosin, modified rosin, terpene resin, phenolic resin, aliphatic or alicyclic hydrocarbon resin, aromatic petroleum resin, and the like, which may be used either singly or as a mixture.

The shell resin may also contain a charge controller conventionally used for toners such as metal-containing dyes or nigrosine in an appropriate amount.

For the capsule toner of the present invention, dyes and pigments used as colorants for toners in the art may be all available, as desired, and they can be added in the core material or in either one or both of the shells.

The microcapsule toner can be prepared by, for example, first melting and kneading the pressure-fixable component as described above, a magnetic material and other optional additives and micropulverizing the mixture by way of, for example, spray drying the molten mixture in air into fine particles to prepare a core material with an average particle size of about 5 to 12μ, which core material is in turn, microencapsulated successively in a first shell layer and in a second shell layer.

As the method for formation by encapsulation of the first shell layer of the present invention, for example, the in-situ polymerization method may be used. More specifically, the fine particulate core material as prepared above may be dispersed in an aqueous solution of a prepolymer obtained as the result of the reaction of formaldehyde with a phenol or a compound having an amino group and heated, while adjusting the pH, whereby a formaldehyde copolymer resin such as a phenol resin or aminoplast can be precipitated around the core material. The first shell layer may have a film thickness preferably of 0.01 to 1μ, more preferably 0.1 to 0.2μ.

As the method for encapsulation of the second shell layer, for example, the phase separation method from an organic solvent may be available. More specifically, the core material coated with the first shell layer is dispersed in a solution of the polymer for the second shell layer, and a poor solvent, which is miscible with the good solvent having dissolved the polymer therein but does not dissolve the polymer, is added dropwise into the resultant solution, thereby effecting phase separation of the polymer, which is precipitated to provide a coating as the second shell layer on the core material coated with the first shell layer.

The second shell layer should preferably have a thickness of 0.01 to 1μ, more preferably 0.1 to 0.2μ.

The microcapsule toner of the present invention thus obtained can be used for development of the electrostatic latent images according to all the electrophotographic developing methods using a magnetic toner, typically the magnetic brush method, the jumping developing method, and others.

The images obtained by use of the toner of the present invention can be fixed by passing through a pair of rollers under a load of a pressure, and auxiliary heating may also be applied, if desired.

Concerning pressure fixing devices, there are various disclosures in Japanese Patent Publication No. 12797/1969, U.S. Pat. Nos. 3,269,626, 3,612,682, 3,655,282 and 3,731,358, and the toner of the present invention is applicable for these devices.

The present invention is described in more detail by referring to the following Examples.

EXAMPLE 1

A mixture of 480 g of 37% formalin and 240 g of urea adjusted to pH 8.0 with triethanolamine was heated at 70° C. for one hour and then one liter of deionized water was added to the mixture to obtain an aqueous solution of a prepolymer.

The above prepolymer solution was sampled in an amount of 100 cc and diluted to 3 liters with deionized water, and the diluted solution was adjusted to pH 5.0 with addition of 10% citric acid. Into this solution was dispersed 1 kg of a core material with an average particle size of 8μ obtained by melting and spray drying of a mixture of 100 parts by weight of a low molecular weight polyethylene and 70 parts of magnetic powder (magnetite) with stirring by means of a homo-mixer (produced by Tokushu Kika Kogyo K. K.).

Then, while continuing stirring, 10% citric acid was added to adjust pH to 3.5 and the product after the reaction continued at 40° to 45° C. for 4 hours was quenched to 5° C. to complete encapsulation.

The above aqueous dispersion was filtered by means of a vacuum filtrating machine, washed and further filtered. The filtered product was left to stand in a drier at 50° C. for 24 hours to obtain the core material coated with about 0.05μ thick shell of a condensation product of urea and formaldehyde which was the first shell layer.

One kilogram (1 kg) of the core material coated with the first shell layer was dispersed in a solution with a recipe as shown below by means of an automatic homo-mixer.

| | |
|---|---|
| Styrene-dimethylaminoethyl methacrylate (polymerization ratio 90:10) | 50 g |
| Dimethylformamide | 4 liter |

While continuing stirring by the automatic homo-mixer, one liter of deionized water was added dropwise at the rate of 10 cc/min. to have styrene-dimethylaminoethyl methacrylate precipitated through phase separation as the second shell layer around the first shell layer.

The aqueous dispersion system was filtered by means of a vacuum filtrating machine, washed and further filtered. The product was dried in a drier at 50° C. for 24 hours to obtain a microcapsule toner with a double-wall microcapsule toner coated with the second shell layer.

The above toner was used for image formation by means of a copying machine (PC-10 produced by Canon K. K.) in which only the fixing part was replaced with a pressure fixing device. As the result, clear images without fog were obtained.

Even after the durability test for 2000 sheets of copying, no deterioration of image was observed.

COMPARATIVE EXAMPLE 1

After encapsulation according to the same method as in Example 1 except for providing no first shell layer, the product obtained after filtration and washing was used for image formation similarly as in Example 1. But, the toner was not attached uniformly on the sleeve (toner carrying member), and therefore the resultant image was inferior, having a portion contaminated with black streaks and a portion with no toner attached on the image portion.

| | Number of sheets successive copying | Start | 500 | 1000 | 1500 | 2000 |
|---|---|---|---|---|---|---|
| Example 1 | Image density | 1.19 | 1.15 | 1.20 | 1.18 | 1.17 |
| | Ground density | 0.10 | 0.09 | 0.10 | 0.11 | 0.09 |
| Comparative Example 1 | Image density | 0.70 | 0.50 | 0.30 | 0.40 | 0.35 |
| | Ground density | 0.20 | 0.15 | 0.18 | 0.20 | 0.20 |

EXAMPLE 2

| | |
|---|---|
| Water | 200 ml |
| 5% Aqueous polyvinyl alcohol solution | 160 ml |
| Resorcinol | 12 g |
| Urea | 3 g |

In the above solution was dispersed 500 g of a core material with an average particle size of 8μ consisting of the same low molecular weight polyethylene and the magnetic material as used in Example 1 and pH was adjusted to 1.6–1.8 by dropwise addition of 10% sulfuric acid. Then, while stirring the mixture by means of an automatic homo-mixer, the temperature of the system was adjusted to 40° –45° C. and stirring was continued thereat for 2 hours. To this mixture were added dropwise 60 ml of water and 30 ml of 27% formalin, and the temperature was further elevated to 55° C., whereat the reaction was continued while continuing stirring for 3 hours. This dispersion system was cooled to room temperature and adjusted to pH 4.5, followed by filtration, washing, filtration and drying to obtain a core material coated with the reaction product of resorcinol-formaldehyde which was the first shell layer. The core material coated with the first shell layer thus prepared (500 g) was dispersed in a solution having the following composition at 40° C. with stirring by an automatic homo-mixer.

| | |
|---|---|
| Polystyrene | 25 g |
| Spiron black BHH | 0.25 g |
| Xylene | 1.5 liter |

While further continuing stirring, 200 cc of petroleum was added and then the temperature of the system was lowered at a rate of 1° C./2 min. to be cooled to 5° C., thereby precipitating polystyrene and Spiron black BHH around the first shell layer.

The above dispersion was subjected to filtration, washing and filtration, and the product was dried in a drier for 24 hours to obtain a double-wall microcapsule toner.

When the above toner was used for copying by means of a copying machine (Canon NP-400 RE), clear images without fog could be obtained. No deterioration was observed either in successive copying of 20,000 sheets.

What is claimed is:

1. A microcapsule toner for pressure fixing, comprising a core material containing a pressure-fixable component and a magnetic material, a first shell layer comprising a formaldehyde copolymer resin and a second shell layer comprising a polymer soluble in an organic solvent.

2. A microcapsule toner according to claim 1, wherein the formaldehyde copolymer resin is obtained by addition and/or condensation reaction of formaldehyde and a comonomer.

3. A microcapsule toner according to claim 1, wherein the formaldehyde copolymer resin is a phenol-formaldehyde resin.

4. A microcapsule toner according to claim 1, wherein the formaldehyde resin is an aminoplast resin.

5. A microcapsule toner according to claim 1, wherein the first shell layer is formed by in situ polymerization in the presence of a core material.

6. A microcapsule toner according to claim 2, wherein the first shell layer is obtained by dispersing a core material in an aqueous solution of a prepolymer formed by the reaction of formaldehyde and a comonomer and adjusting the pH of the aqueous solution.

7. A microcapsule toner according to claim 1, wherein the second shell layer is formed by phase separation of said polymer from an organic solution.

8. A microcapsule toner according to claim 1, wherein the first shell layer has a thickness of 0.01 to 1$\mu$.

9. A microcapsule toner according to claim 1, wherein the second shell layer has a thickness of 0.01 to 1$\mu$.

10. A microcapsule toner according to claim 1, wherein the pressure-fixable component is constituted of a soft material having a penetration of not less than 1.

11. A process for preparing a pressure-fixable microcapsule toner, which comprises dispersing fine particles of a core material containing a pressure-fixable component and a magnetic material in an aqueous solution of a prepolymer formed by addition and/or condensation reaction of a formaldehyde and a comonomer and adjusting the pH of said aqueous solution to form a first shell layer comprising a formaldehyde copolymer resin on the fine particles of said core material, dispersing the fine particles of said core material thus coated with the first shell layer in an organic solution of a polymer and adding a non-solvent for said polymer which is miscible with the organic solvent in said organic solution, thereby effecting precipitation of said polymer to form a second layer on the first shell layer.

* * * * *